United States Patent [19]

Rowling

[11] 4,229,926

[45] Oct. 28, 1980

[54] METHOD OF MAKING BOOKLET

[75] Inventor: Sidney Rowling, Wynnewood, Pa.

[73] Assignee: Jack Seidman, Philadelphia, Pa. ; a part interest

[21] Appl. No.: 662,749

[22] Filed: Mar. 1, 1976

Related U.S. Application Data

[63] Continuation of Ser. No. 541,307, Jan. 15, 1975, abandoned.

[51] Int. Cl.[3] ..... B65B 9/02; B65B 63/04

[52] U.S. Cl. ..... 53/429; 53/450

[58] Field of Search ..... 53/21 FW, 117, 120, 53/180 R, 429, 450, 23, 178; 206/232, 812; 229/66; 283/56, 62

[56] References Cited

U.S. PATENT DOCUMENTS

| | | | |
|---|---|---|---|
| 1,363,081 | 12/1920 | Brown | 283/62 |
| 2,673,430 | 3/1954 | Fleischer et al. | 53/178 |
| 3,184,149 | 5/1965 | Repko | 229/66 |
| 3,242,637 | 3/1966 | Wills | 53/117 X |
| 3,253,384 | 5/1966 | Huck et al. | 53/117 X |
| 3,286,435 | 11/1966 | Weinberger | 53/117 |
| 3,339,337 | 9/1967 | Rapp et al. | 53/180 |
| 3,439,469 | 4/1969 | Van Mil, Jr. | 53/120 |
| 3,465,492 | 9/1969 | Jensen | 53/120 |
| 3,477,200 | 11/1969 | Weinberger et al. | 53/120 |
| 3,588,085 | 6/1971 | Bailey | 283/56 X |
| 3,738,686 | 7/1973 | Morse | 283/62 X |

OTHER PUBLICATIONS

"Baumfolder Imposition Manual," by Baumfolder Division–Bell and Howell Company–Fig. No. 110–Oct. 1966.

*Primary Examiner*—John Sipos

*Attorney, Agent, or Firm*—Seidel, Gonda, Goldhammer & Panitch

[57] ABSTRACT

A thin lightweight booklet and method of making the same are disclosed. The booklet is comprised of one elongated sheet folded in thirds, then in half, then in half to define pages of the same size without the use of fasteners. The sheet is folded so as to have a fold line between and adjacent the free ends of said sheet at one end of the booklet and only a fold line at the other end of said booklet. The booklet is adapted to be sealed within an envelope.

4 Claims, 7 Drawing Figures

10
12
14
16
18
20
21
22
23
24
26
28
30
32
33
36
34
38
54
56
62
50b
3
6
9
12
15
18
21
24
27
30
33
36

FIG. 4
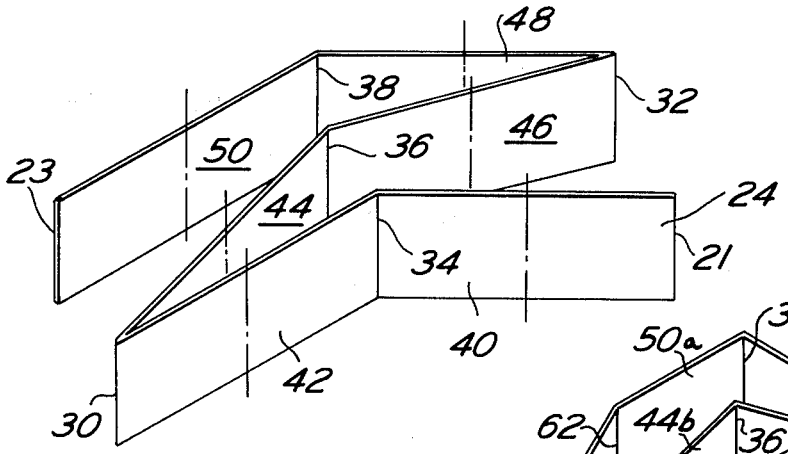
FIG. 5
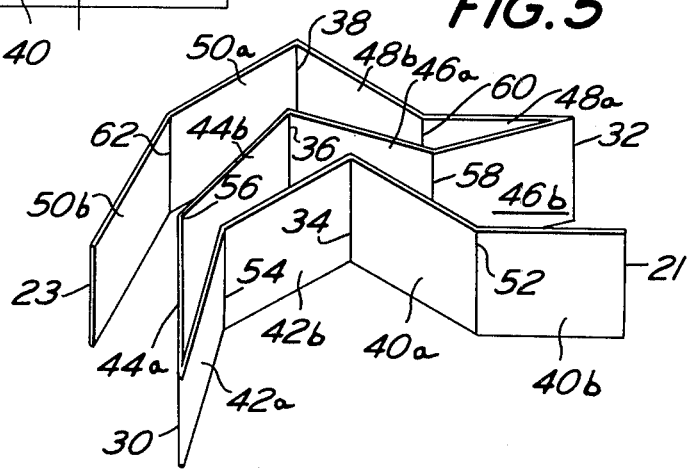
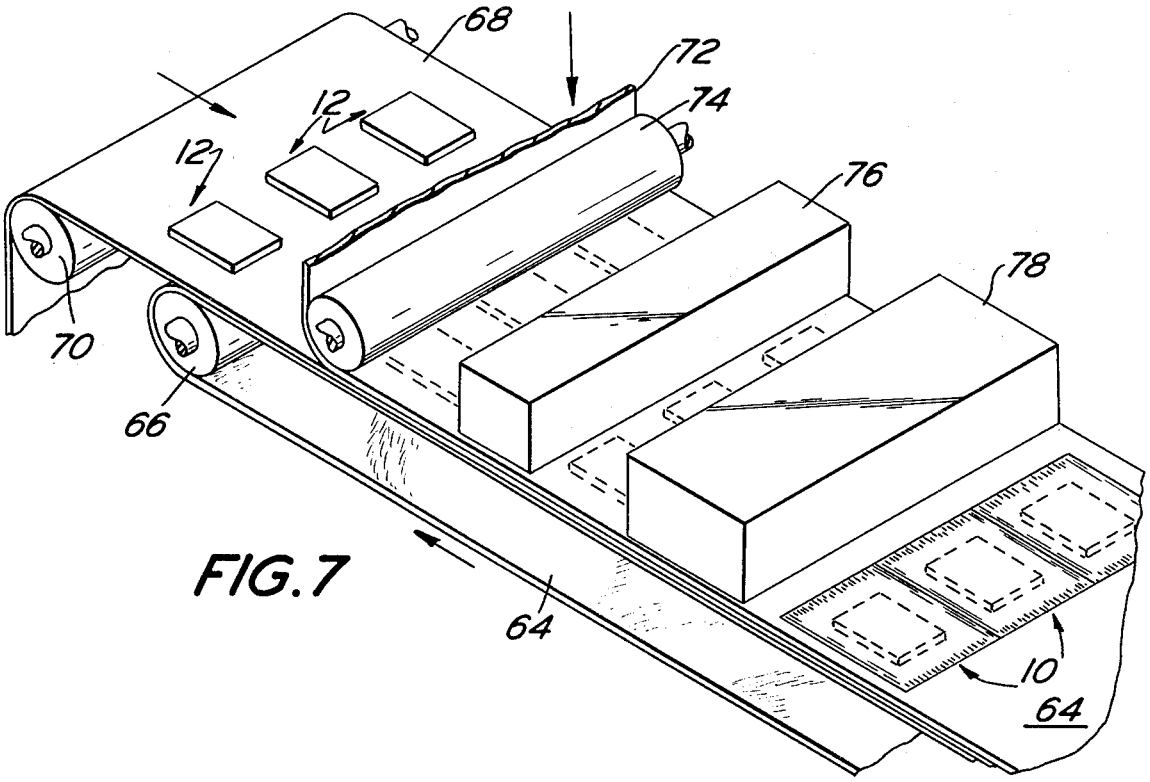
FIG. 7

METHOD OF MAKING BOOKLET

This is a continuation of application Ser. No. 541,307, filed Jan. 15, 1975, now abandoned.

BACKGROUND

The usual booklet is comprised of a plurality of pages adhesively or mechanically connected together. A booklet formed in that manner is objectionable from the viewpoint of cost as well as thickness. As a result thereof, booklets constructed in a conventional manner are not readily adapted for use as a premium as compared with the present invention. A premium is a product which is given away for purposes of advertising, is included within a box of cereal, etc. As a premium, the prime considerations are size and weight in addition to cost.

The present invention is directed to an article comprising an envelope containing a booklet which is constructed of one elongated sheet folded to define pages of the same size without the use of fasteners. The paper sheet is folded first in thirds, then in half, and then in half so as to produce a fold line between and adjacent the free ends of the sheet at one end of the booklet and only fold lines at the other end of the booklet.

As a result of the manner in which the sheet is folded, the booklet has minimum size and thickness while being capable of being handled by automated equipment so that it may be inserted into an envelope. As a result thereof, the size weight and price of the booklet are at a minimum. In an operative embodiment of the present invention, a booklet having 24 pages, each page being $2\frac{1}{4}$ by 3 inches, and comprised of 60 pound coated paper, has an overall thickness of about 0.045 inches.

It is an object of the present invention to provide a novel article comprising an envelope containing a thin, lightweight booklet made from an elongated sheet folded to define pages of the same size without the use of fasteners.

It is another object of the present invention to provide a novel method of constructing an article comprised of an envelope containing a booklet as disclosed herein.

Other objects will appear hereinafter.

For the purpose of illustrating the invention, there is shown in the drawings a form which is presently preferred; it being understood, however, that this invention is not limited to the precise arrangements and instrumentalities shown.

FIG. 4 is a perspective view of the sheet shown in FIG. 3 but illustrating a subsequent folding step.

FIG. 5 is a perspective view of the sheet shown in FIG. 4 but illustrating a subsequent folding step.

FIG. 7 is a partial perspective view of apparatus for encasing the booklets in an envelope.

Referring to the drawing in detail, wherein like numerals indicate like elements, there is shown in FIG. 1 an article in accordance with the present invention designated generally as 10.

Figures 1, 2, 3, 6:
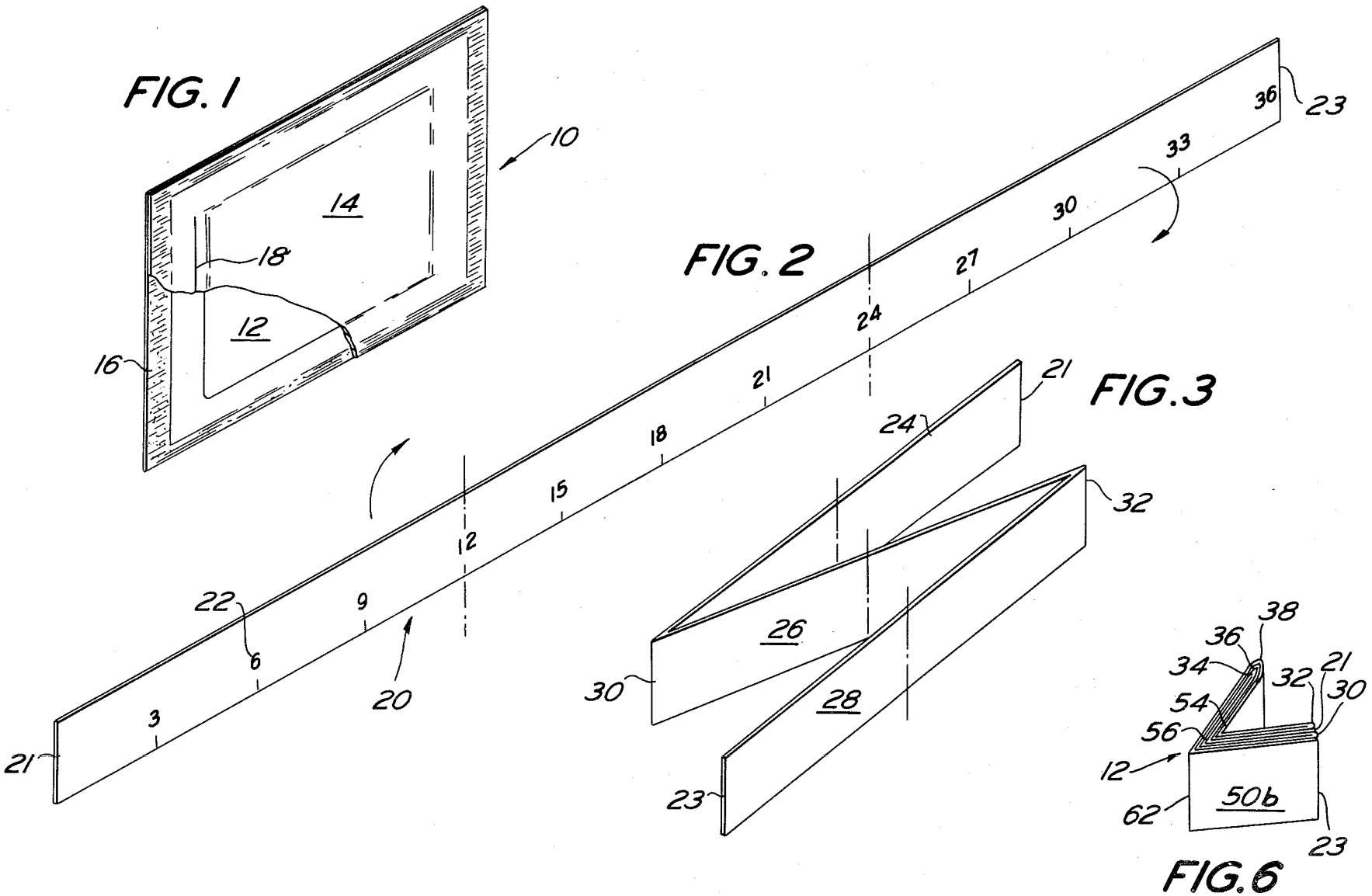
FIG. 1 is a perspective view, partly broken away, of an article in accordance with the present invention.
FIG. 2 is a perspective view of a sheet from which the booklet is formed.
FIG. 3 illustrates the sheet shown in FIG. 2 but after a first folding step wherein the sheet is divided into thirds.
FIG. 6 is a perspective view of the booklet.

The article 10 includes a booklet 12 disposed within an envelope 14. The envelope 14 is preferably comprised of two layers of paper with a heat seal 16 joining the peripheral edges thereof. The envelope 14 is preferably provided with a slit 18 to facilitate removal of the booklet 12 from the envelope 14.

The booklet 12 is comprised of a plurality of pages of the same size attained by folding a sheet 20 in a predetermined manner. The sheet 20 may be 36 inches long and $22\frac{1}{2}$ inches wide so that ten booklets are produced at the same time. The portion of sheet 20 for producing only a single booklet 12 is shown in FIG. 2 containing printed matter 22. The printed matter 22 is preferably offset printed on both sides of the sheet 20 and may attain a wide variety of forms. As illustrated in FIG. 2, the printing 22 is comprised of numerals forming a part of a yardstick but may include advertisements, recipes, jokes, a story, etc.

As shown in FIG. 3, the first step is to fold the sheet 20 in thirds so as to define panels 24 and 26 separated by fold line 30 and panel 28 separated from panel 26 by fold line 32. Thereafter, the thusly folded sheet 20 as shown in FIG. 3 is folded in half at fold lines 34, 36 and 38 as shown in FIG. 4. Fold line 34 divides panel 24 into panels 40 and 42. Fold line 36 divided panel 26 into panels 44 and 46. Fold line 38 divided panel 28 into panels 48 and 50.

The thusly folded sheet as shown in FIG. 4 is then again folded in half as shown in FIG. 5. Thus, fold line 52 divided panel 40 into pages **40*a* and 40*b*. Fold line 54 divided panel 42 into pages 42*a* and 42*b*. Fold line 56 divided panel 44 into pages 44*a* and 44*b***.

Fold line 58 divided panel 46 into pages **46*a* and 46*b*. Fold line 60 divided panel 48 into pages 48*a* and 48*b*. Fold line 62 divided panel 50 into front cover page 50*a* and rear cover page 50*b***.

The completely folded booklet 12 is shown in FIG. 6. As indicated above, the strip 20 was first folded in thirds, then in half, and then in half again. It will be noted that the free ends 21 and 23 of the sheet 20 appear at the same end of the booklet and are separated by pages **42*a* and 44*a* which are joined together by the fold line 30. At the opposite end of the booklet 12, each page is connected to an adjacent page by one of the six fold lines 52, 54, 56, 58, 60, 62. As a result of the arrangement of fold lines and the free ends of the booklet 12, a plurality of such booklets may be introduced into a conventional hopper and removed therefrom with fold line 62 being the leading edge by a conventional suction cup feeder or equivalent device. A plurality of parallel hoppers are preferably utilized so that a plurality of booklets 12 are simultaneously fed to the sealing apparatus shown in FIG. 7. The apparatus shown in FIG. 7 includes an endless belt 64 extending around a pair of rollers, but only roller 66** is shown. One of the rollers is a driven roller.

The suction cups or equivalent device deposit three booklets 12 onto the upper surface of a paper web 68. Web 68 extends from a roll, around idler roller 70, and then overlies the top run of the belt 64. The booklets 12 are continuously deposited onto the moving web 68 in transverse rows such as three across as shown in FIG. 7.

A web 72 is unwound from a roll and extends downwardly toward the belt 64, around idler roller 74, and overlies the web 68 with the booklets 12 thereon. The thusly assembled components pass beneath a conventional heat sealer 76 which heat seals the webs 68 and 72 in the spaces between adjacent booklets 12 and on the edges thereof. Thereafter, the cutter 78 slits the heat sealed areas to delineate the discrete articles 10.

In the above embodiment, the sheet 20 was initially 36 inches long thereby producing 24 pages each 3 inches long. The 24 pages are attained by counting both sides of the 12 panels. One or more of said fold lines can include perforations to facilitate separating pages. The total thickness of the article 10 when using 60 pound coated paper was only 0.045 inches. The paper was coated with clay in a conventional manner. The clay coating enables the paper to be thinner than a conventional 60 pound paper which is uncoated. The clay coating on the sheet 20 may include pigments if desired. In addition to adding weight to the paper, the clay coating provides a finish for good printing quality, smoothness, and for receipt of colored printing 22.

As pointed out above, the sheet 20 is preferably sufficiently wide so as to produce a plurality of booklets such as 10 booklets side by side. When a plurality of booklets are so produced, there is an intermediate slitting step to delineate the booklets before they are introduced into the hopper from which they are subsequently fed by a suction cup or the like onto the web 68.

The article 10 is adapted to be used as a premium in a cereal box, as a giveaway for purposes of advertisement, etc. When produced in accordance with the invention as disclosed herein, the article 10 can be produced for several pennies apiece if a sufficiently large number are produced in a production run. The webs 68 and 72 are not only treated so that they may be heat sealed to one another, but preferably are also coated in a conventional manner so that they may be in contact with edible foods when introduced into a cereal box or the like. In a preferred embodiment of the present invention, the article 10 as illustrated has an overall size of approximately $4\frac{1}{2}$ by $3\frac{1}{4}$ inches and a weight of approximately 1/64 of an ounce.

The present invention may be embodied in other specific forms without departing from the spirit or essential attributes thereof and, accordingly, reference should be made to the appended claims, rather than to the foregoing specification as indicating the scope of the invention.

I claim:

1. A method comprising the steps of printing on an elongated paper sheet in a direction parallel to the longest edge of said sheet, folding said printed sheet transversely into thirds, said folding step being accomplished in a manner so that a third of said sheet at one end overlies one face of the middle third of the sheet and the remaining third of the sheet is juxtaposed to the opposite face of the middle third of the sheet, then folding the sheet in half, then folding the sheet in half again, to thereby provide a booket having pages of the same size without the use of fasteners and only fold lines at one end thereof, introducing the thusly folded booklet into an envelope, sealing said booklet within said envelope, slitting the folded booklet in a direction perpendicular to said fold lines before it is introduced into the envelope so as to define a plurality of discrete booklets each having a width narrower than the width of said sheet, and producing by said folding steps a booklet having dimensions of approximately three inches in length by approximately $2\frac{1}{4}$ inches in width before introducing said booklet into said envelope.

2. A method in accordance with claim 1 wherein said step of introducing the folded booklet into an envelope includes simultaneously feeding a plurality of booklets side by side onto the upper surface of a first web, heat sealing a second web to the first web in overlying relation with respect to said booklets, and then cutting through heat sealed areas to delineate said envelopes each containing one of said booklets.

3. A method according to claim 1 including cutting at least one layer of said envelope to facilitate access to said booklet.

4. A method according to claim 1 including cutting said envelope adjacent one end thereof to facilitate access to said booklet.

* * * * *